US005771666A

United States Patent [19]

Bertuzzi et al.

[11] Patent Number: 5,771,666

[45] Date of Patent: Jun. 30, 1998

[54] METHOD OF CONTINUOUSLY WRAPPING PRODUCTS

[75] Inventors: Francesco Bertuzzi, Vedrana Di Budrio; Fabio Sassi, Imola; Fiorenzo Draghetti, Medicina, all of Italy

[73] Assignee: G.D Societa' Per Azioni, Bologna, Italy

[21] Appl. No.: 641,851

[22] Filed: May 2, 1996

[30] Foreign Application Priority Data

May 10, 1995 [IT] Italy ..... B095A0210

[51] Int. Cl.[6] ..... B65B 11/00

[52] U.S. Cl. ..... 53/466; 53/228; 53/234; 493/910; 493/166

[58] Field of Search ..... 53/466, 225, 234, 53/444, 228, 233, 575; 493/910, 911, 164, 166, 163

[56] References Cited

U.S. PATENT DOCUMENTS

| | | | |
|---|---|---|---|
| 2,870,584 | 1/1959 | Sherrill | 53/575 |
| 3,735,767 | 5/1973 | Krase et al. | 53/444 |
| 3,802,325 | 4/1974 | Bargenhagen et al. | 53/575 |
| 4,823,536 | 4/1989 | Manservigi et al. | 53/234 |
| 4,838,846 | 6/1989 | Focke et al. | 493/164 |
| 4,852,335 | 8/1989 | Focke et al. | 53/234 |
| 5,003,755 | 4/1991 | Draghetti | 53/466 |
| 5,177,933 | 1/1993 | Boriani et al. | 53/234 |
| 5,324,250 | 6/1994 | Janson et al. | 493/164 |
| 5,457,932 | 10/1995 | Spada et al. | 53/234 |

FOREIGN PATENT DOCUMENTS

| | | |
|---|---|---|
| 0553636 | 8/1993 | European Pat. Off. . |
| 237734 | 8/1925 | United Kingdom . |
| 2246109 | 1/1992 | United Kingdom . |

*Primary Examiner*—John Sipos
*Assistant Examiner*—Gene L. Kim
*Attorney, Agent, or Firm*—Ladas & Parry

[57] ABSTRACT

A method of continuously wrapping products, whereby at least one seat for a respective product is fed continuously along a given path together with a respective retaining element for retaining a respective sheet of wrapping material, which is supplied in such a manner that a first portion is positioned over the seat, and a second portion is engaged by the retaining element; a product is inserted continuously inside the seat so as to fold at least the first portion of the sheet substantially in a U; and the retaining element is so moved as to fold at least part of the second portion of the sheet about the product.

13 Claims, 7 Drawing Sheets

15
7
6
A4
B1
A2
A3
A
A1
B
68
71
1A
12
3
2
1
4
17
18
19
21
20
5
10
11
14
13
46
36
34
43
44
42
41

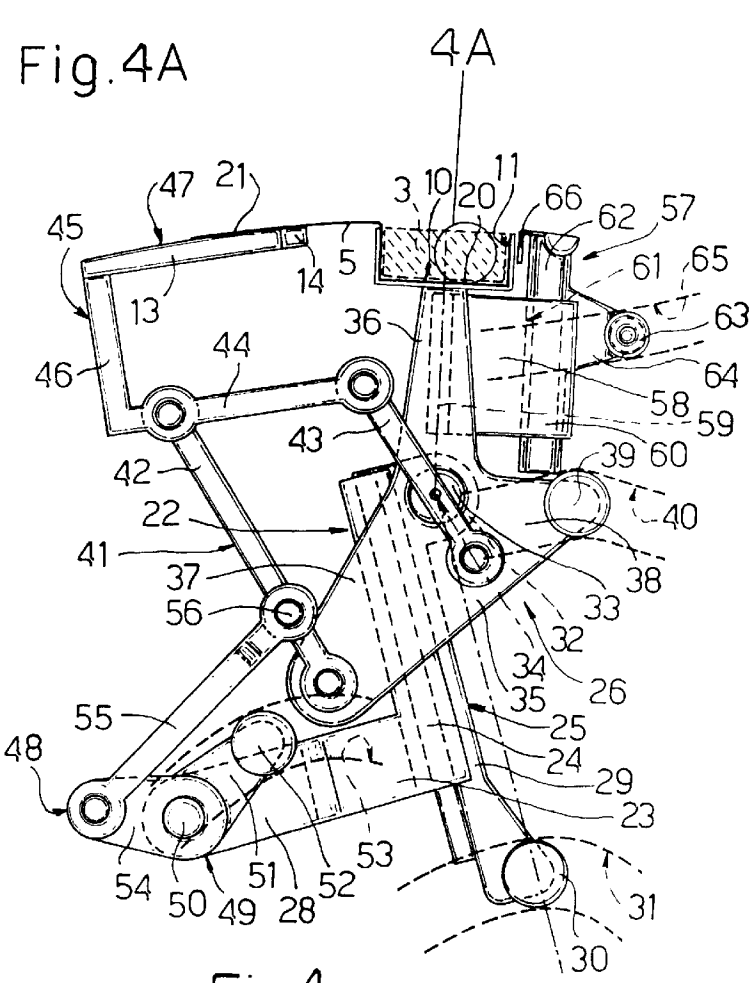
Fig.4A
Fig.4
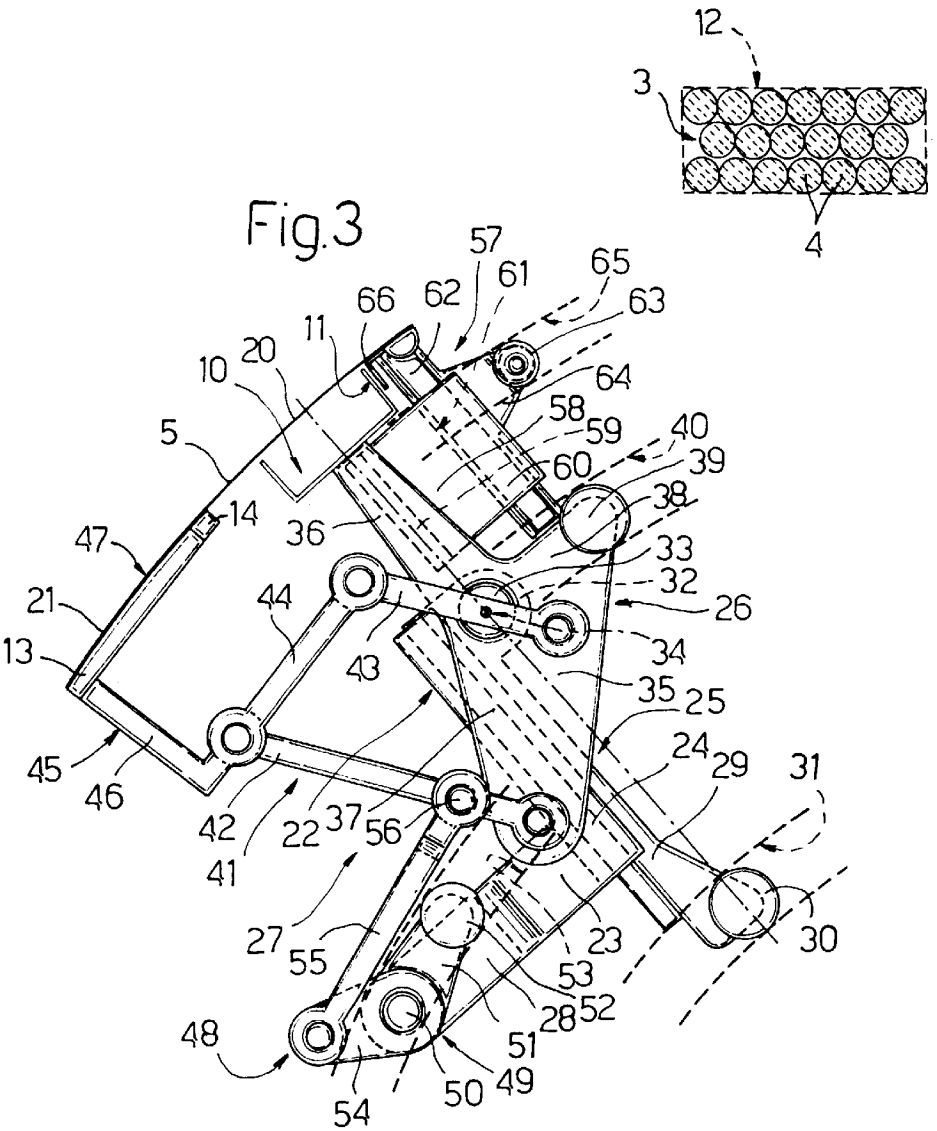
Fig.3 a)
b)
c)
d)
e)
9A
9B
15
16
67
68
69
70
71
72
73
74
75
76
77
78
3
12
5
6
9
10
20
21
21a
23
24
28
29
30
31
35
39
40
42
43
49
50
51
52
53
54
55
56

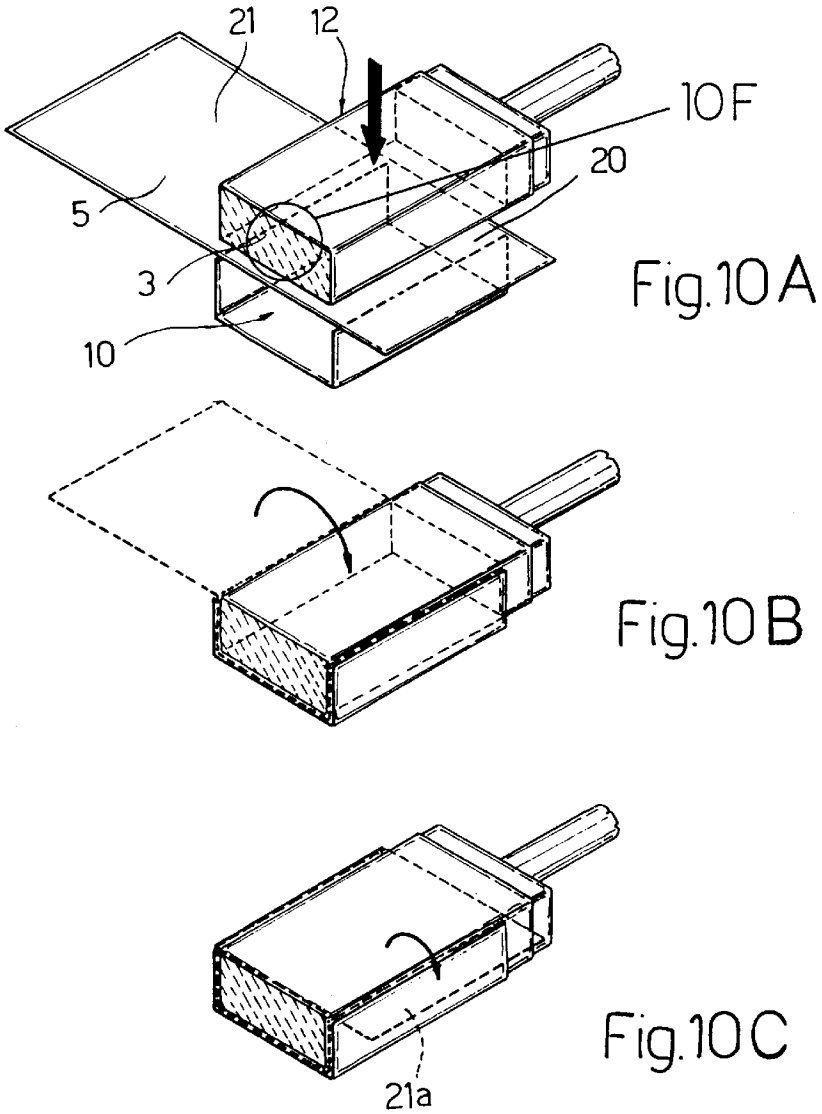
Fig.10A
Fig.10B
Fig.10C
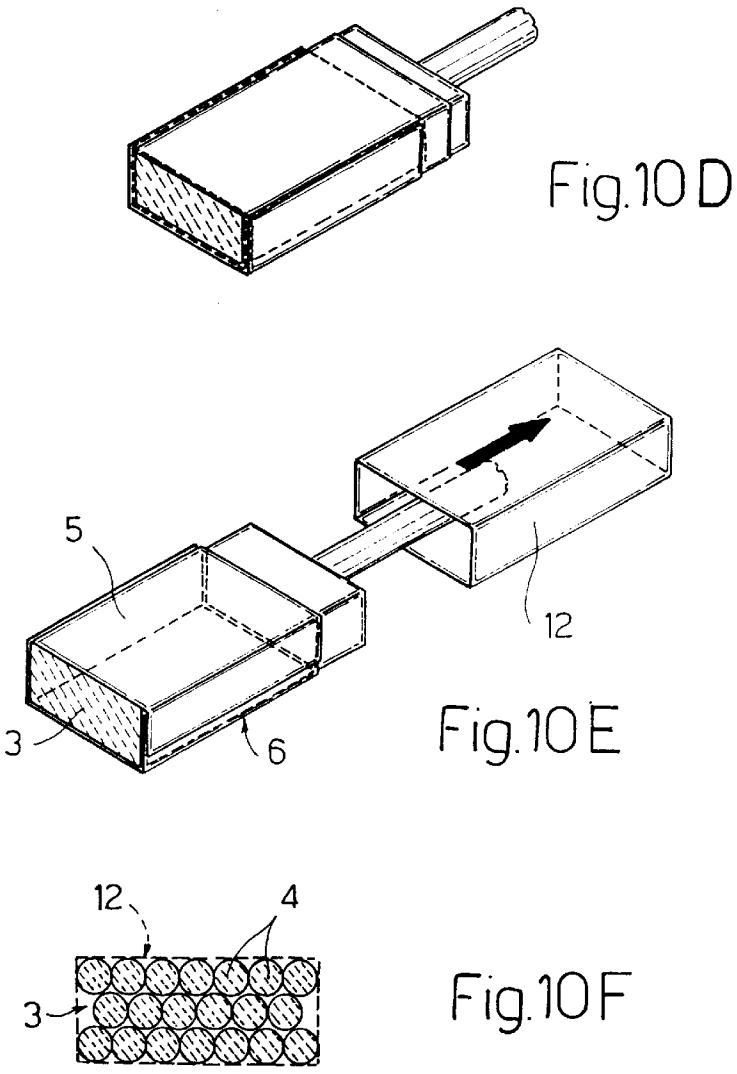
Fig.10D
Fig.10E
Fig.10F

METHOD OF CONTINUOUSLY WRAPPING PRODUCTS

BACKGROUND OF THE INVENTION

The present invention relates to a method of continuously wrapping products.

The method according to the present invention is particularly advantageous for use in the tobacco industry, for continuously packing products comprising groups of cigarettes, to which the following description refers purely by way of example.

In the tobacco industry, groups of cigarettes are wrapped on packing machines which, being operated wholly or partly in steps, are limited to a given maximum output speed, over and above which vibration would be such as to jeopardize the structure and reliability of the machine.

SUMMARY OF THE INVENTION

It is an object of the present invention to provide a straightforward, low-cost method of continuously wrapping products, in particular groups of cigarettes.

According to the present invention, there is provided a method of continuously wrapping products in respective sheets of wrapping material, characterized by comprising the steps of:

continuously feeding along a given path at least one seat for a respective said product, together with a retaining element for retaining a said sheet of wrapping material; the seat presenting a lateral opening, and the retaining element being movable, in relation to the seat, between a first position to the side of the seat, and a second position over the seat and substantially closing said opening;

continuously feeding the sheet of wrapping material in such a manner that a first portion of the sheet is positioned over the seat and closing said opening, and a second portion of the sheet is engaged by the retaining element in said first position to draw the sheet along said path;

continuously inserting said product inside said seat, through said opening, so as to fold at least the first portion of the sheet substantially in a U about the product and inside the seat; and moving the retaining element from the first to the second position, so as to fold at least part of the second portion of the sheet about and onto the product.

BRIEF DESCRIPTION OF THE DRAWINGS

A non-limiting embodiment of the present invention will be described by way of example with reference to the accompanying drawings, in which:

FIGS. 3 to 7 show larger-scale views of a FIG. 2 detail in various operating positions;

FIG. 8 shows a cross section of the FIG. 6 detail;

FIG. 9 shows a front view of a second detail in FIG. 1;

FIGS. 10 and 11 respectively show a schematic view in perspective and a section of an operating sequence of the FIG. 1 machine.

DETAILED DESCRIPTION OF THE INVENTION

Figures 1, 1A:
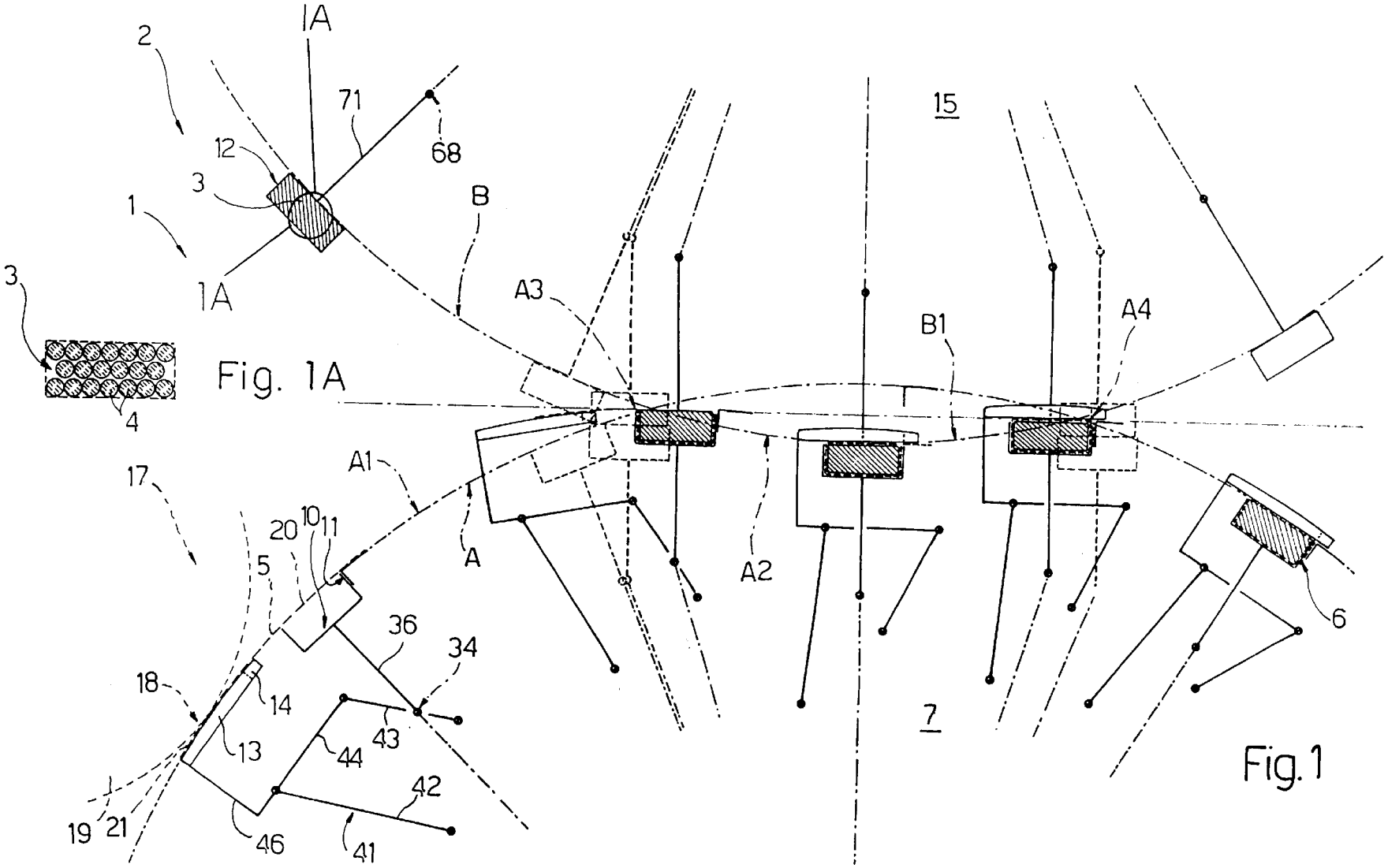
FIG. 1 shows a schematic front view of an intermediate portion of a machine for packing groups of cigarettes and implementing the method according to the present invention.
FIG. 1A shows a detail in FIG. 1.

Number 1 in FIG. 1 indicates a wrapping unit defining an intermediate portion of a packing machine 2 for packing groups 3 of cigarettes 4.

Unit 1 provides for forming a tubular wrapping 6 about each group 3 and from a respective sheet 5 of wrapping material.

Unit 1 comprises a wheel 7 presenting a substantially horizontal axis 8 (FIG. 2) and located facing a fixed face cam 9. Wheel 7 comprises a number of seats 10, each presenting a lateral opening 11 for the insertion, inside seat 10, of a substantially parallelepiped container or mandrel 12 housing a respective group 3. Seats 10 are equally spaced about axis 8, and are each positioned adjacent to a respective retaining element 13 for retaining a respective sheet 5 of wrapping material. Each element 13 presents a comb-shaped end 14, at the front in relation to the rotation direction of wheel 7, and is movable, in relation to respective seat 10, between an idle position to the side of seat 10, and an operating position over seat 10 and substantially closing opening 11. In relation to cam 9, wheel 7 rotates clockwise (in FIG. 1) about axis 8 at substantially constant angular speed, to feed seats 10 and retaining elements 13 along a path A comprising a circular portion A1 substantially coaxial with axis 8 and of over 1800, a curved portion A2 with its concavity facing outwards of wheel 7, and two portions A3, A4 for connecting portions A1 and A2.

Unit 1 also comprises a further wheel 15 facing a fixed cam 16, and rotating anticlockwise (in FIG. 1) about an axis (not shown) parallel to axis 8. Wheel 15 lies in a plane parallel to but offset in relation to that of wheel 7, and supports containers 12 in projecting manner to feed containers 12 along a substantially circular path B, which interferes with path A along an arc B1 substantially coincident with portion A2 of path A. Containers 12 are equally spaced about the axis (not shown) of wheel 15, and are advanced by wheel 15 in such a manner as to travel along arc Bl in time with a respective seat 10 traveling along portion A2.

Finally, unit 1 comprises a supply assembly 17 for continuously supplying a succession of sheets 5 onto wheel 7 at a transfer station 18 located along portion A1 of path A, upstream from portions A3 and A2. Assembly 17 comprises a suction conveyor wheel 19 tangent to path A at station 18, and rotating continuously about an axis (not shown) parallel to axis 8, and at a surface speed equal to that of seats 10 at station 18, to feed sheets 5 to station 18 in time with respective seats 10.

Each sheet 5 is transferred onto wheel 7 in such a manner that a portion 20 is positioned over respective seat .10 and closing opening 11, and a portion 21 is retained by suction by retaining element 13 in said idle position.

Figures 2, 2A:
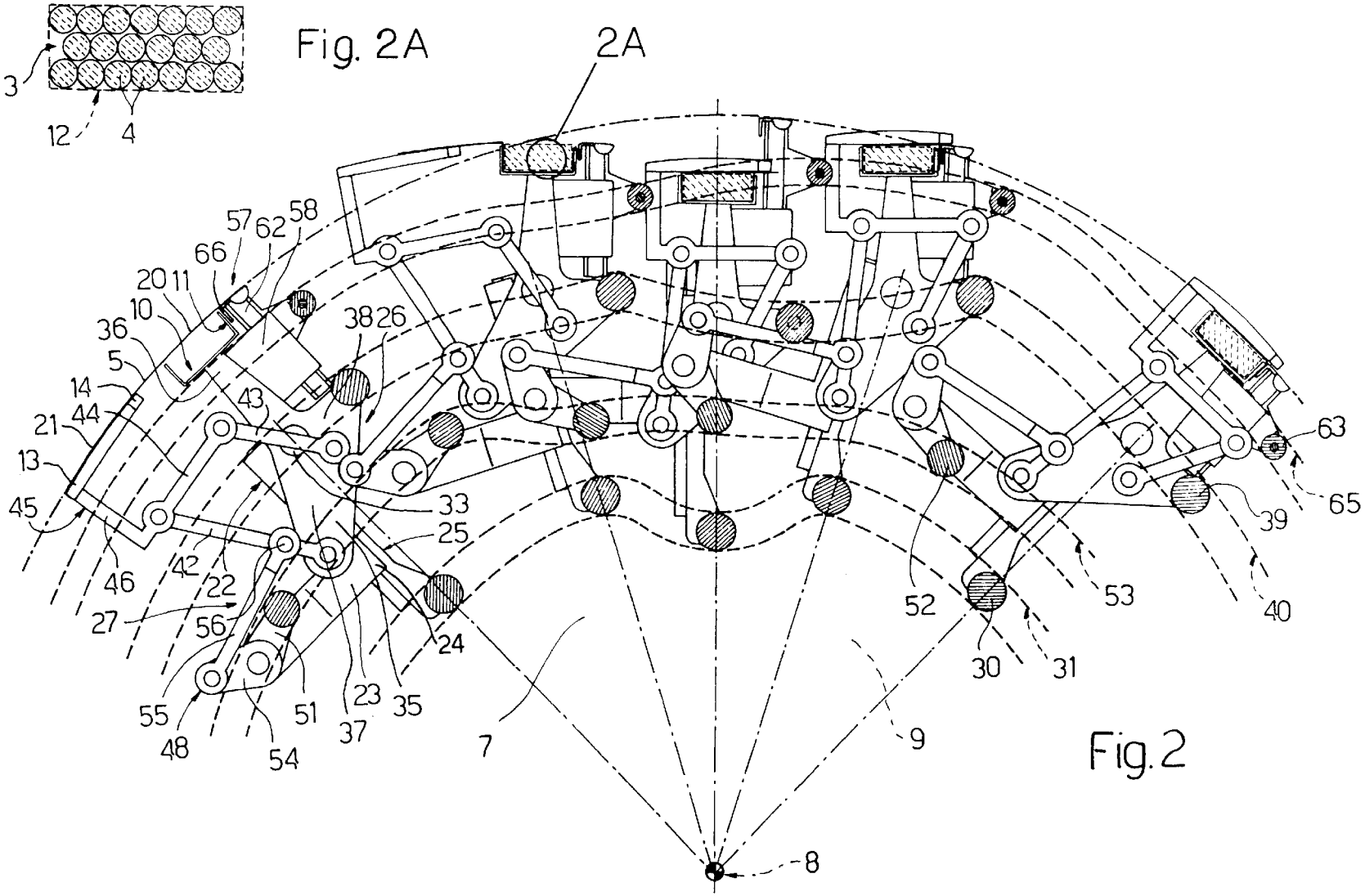
FIG. 2 shows a larger-scale view of a first part of the machine in FIG. 1.
Figure 6:
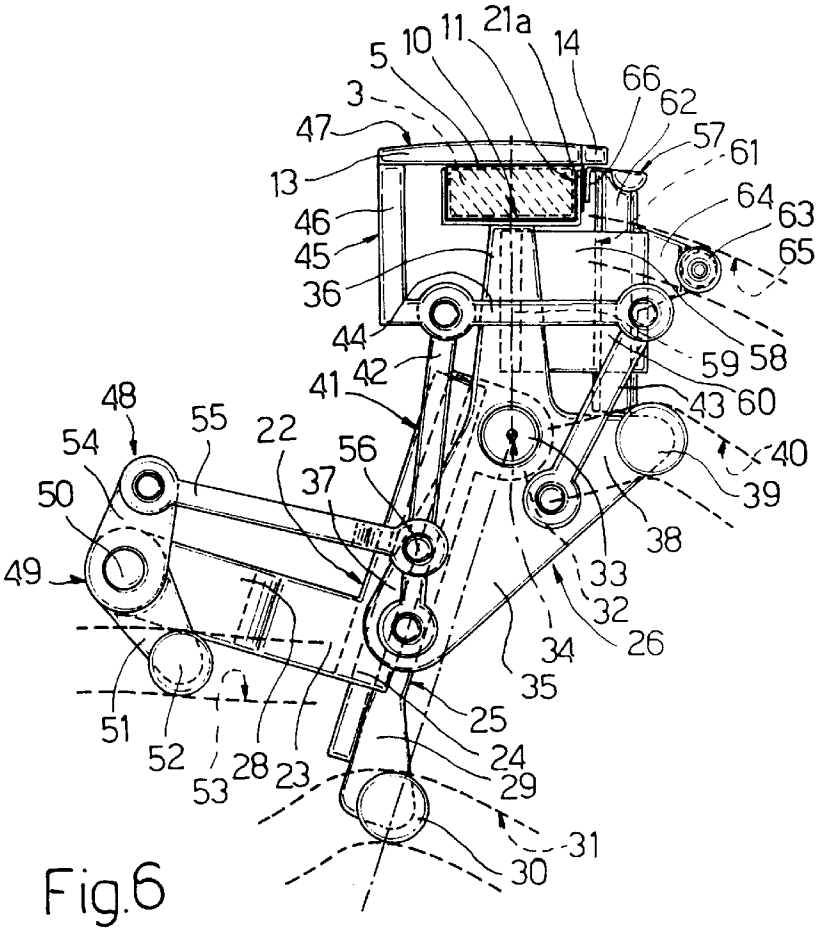
Figure 5:
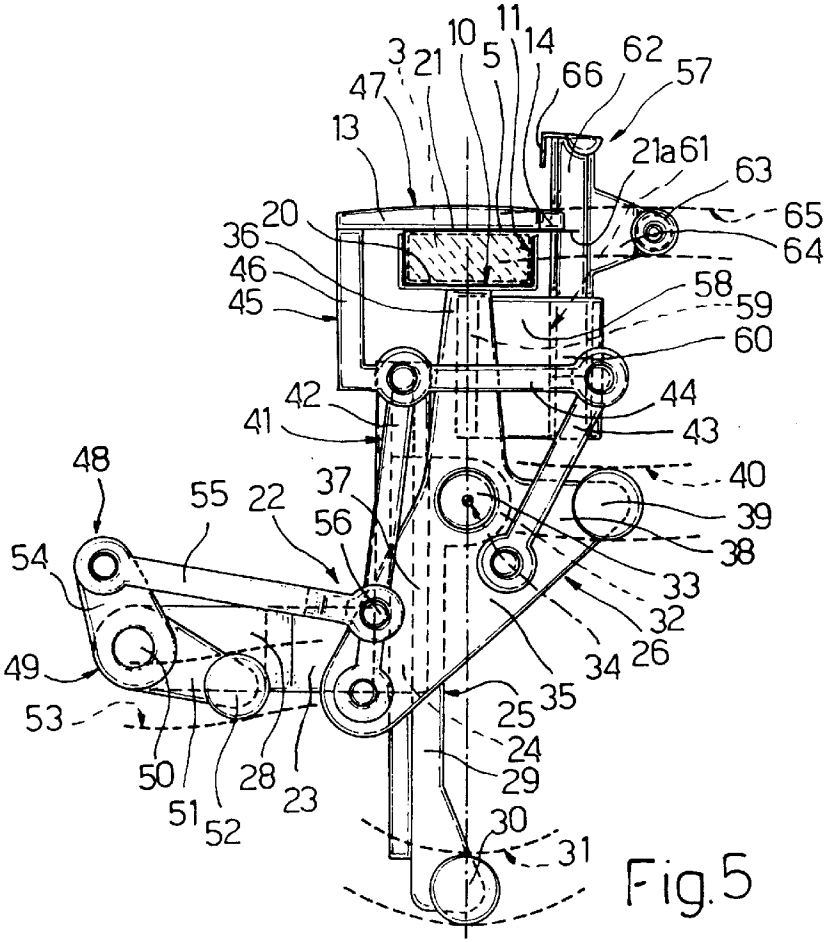
Figure 7:
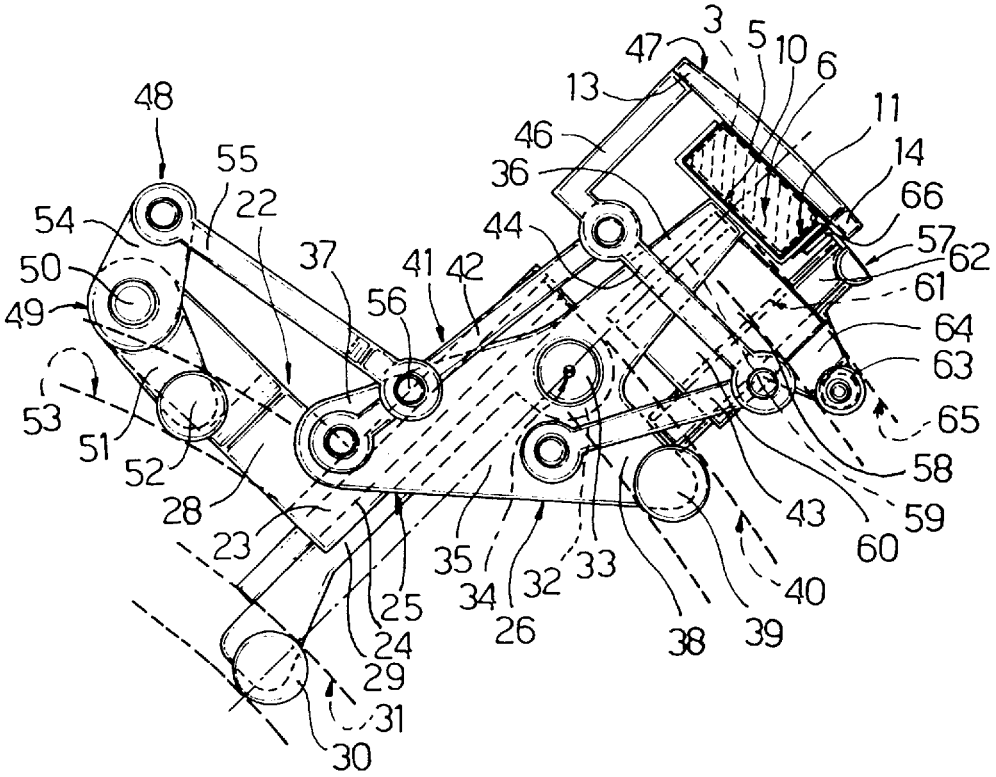

With reference to FIGS. 1 and 2, wheel 7 comprises, for each seat 10, an actuating device 22 comprising a support 23 fixed to wheel 7 and presenting a guide 24 extending radially in relation to wheel 7; a device 25 for controlling the radial position of seat 10 in relation to wheel 7; a device 26 for controlling the angular position of seat 10 in relation to wheel 7; and an actuating assembly 27 movable with respective support 23 about axis 8, and for controlling the movement of retaining element 13 between said idle and operating positions in relation to respective seat 10.

With reference to FIGS. 3 to 8, in addition to guide 24, support 23 comprises an arm 28 extending rearwards, in the rotation direction of wheel 7, from the inner end of guide 24.

Device 25 comprises a slide 29, which is moved along guide 24 by a tappet roller 30 fitted in rotary manner to the inner end of slide 29 and engaged in rolling manner inside an annular groove 31 extending about axis 8 and formed on the surface of cam 9 facing wheel 7. At the opposite end to that fitted with roller 30, slide 29 presents a lateral appendix 32 fitted with a pin 33, which presents an axis 34 parallel to axis 8, and constitutes a pivot for device 26.

Device 26 comprises a rocker arm 35 pivoting on pin 33 and in turn comprising an arm 36 fitted on its free end with seat 10, a further arm 37 substantially opposite arm 36 in relation to pin 33, and a lateral appendix 38 fitted on its free end with a tappet roller 39 rotating about an axis parallel to axis 8 and engaged in rolling manner inside a groove 40 formed on the surface of cam 9 facing wheel 7 to regulate the angular position of rocker arm 35 about axis 34 of respective pin 33.

Assembly 27 comprises an articulated parallelogram 41, in turn comprising a frame defined by arm 37, two cranks 42 and 43 hinged to arm 37 so as to rotate, in relation to arm 37, about respective axes parallel to axis 8, and a connecting rod 44 defined by an arm of a substantially C-shaped element 45 with its concavity facing respective seat 10. In addition to connecting rod 44, element 45 also comprises a core 46 positioned substantially radially in relation to wheel 7, and a second arm parallel to connecting rod 44 and defined by retaining element 13. Element 13 presents a curved outer surface 47 presenting, in knrow-n manner not shown, a number of suction holes (not shown) connected, in known manner not shown, to a suction device (not shown) for retaining portion 21 of respective sheet 5 on surface 47. Finally, assembly 27 comprises an actuating device 48, in turn comprising a rocker arm 49 pivoting at 50 on the free end of arm 28 and in turn comprising an arm 51 fitted on its. free end with a tappet roller 52 rotating about an axis parallel to axis 8 and engaged in rolling manner inside an annular groove 53 extending about axis 8, formed on the surface of cam 9 facing wheel 7, and for oscillating rocker arm 49 about an axis parallel to axis 8. Rocker arm 49 also comprises a further arm 54 hinged at its free end to one end of a connecting rod 55, the other end of which is hinged to a pivot 56 at an intermediate point of crank 42.

Finally, wheel 7 comprises, for each seat 10, a folding assembly 57 located on the opposite side of seat 10 to retaining element 13. Assembly 57 comprises a bracket 58 presenting one end 59, at the rear in relation to the rotation direction of wheel 7, connected integral with arm 36 of rocker arm 35, and a further end 60 fitted with a guide 61 parallel to arm 36. Assembly 57 also comprises a slide 62, which is moved along guide 61 by a tappet roller 63 fitted in rotary manner to an appendix 64 of slide 62 and engaged in rolling manner inside an annular groove 65 extending about axis 8 and formed on the surface of cam 9 facing wheel 7. On its outer end, slide 62 comprises a comb element 66, the teeth of which are parallel to arm 36 of rocker arm 35, and are inserted inside comb-shaped end 14 of retaining element 13 in said operating position.

Figures 8, 9, 9A, 9B, 11:
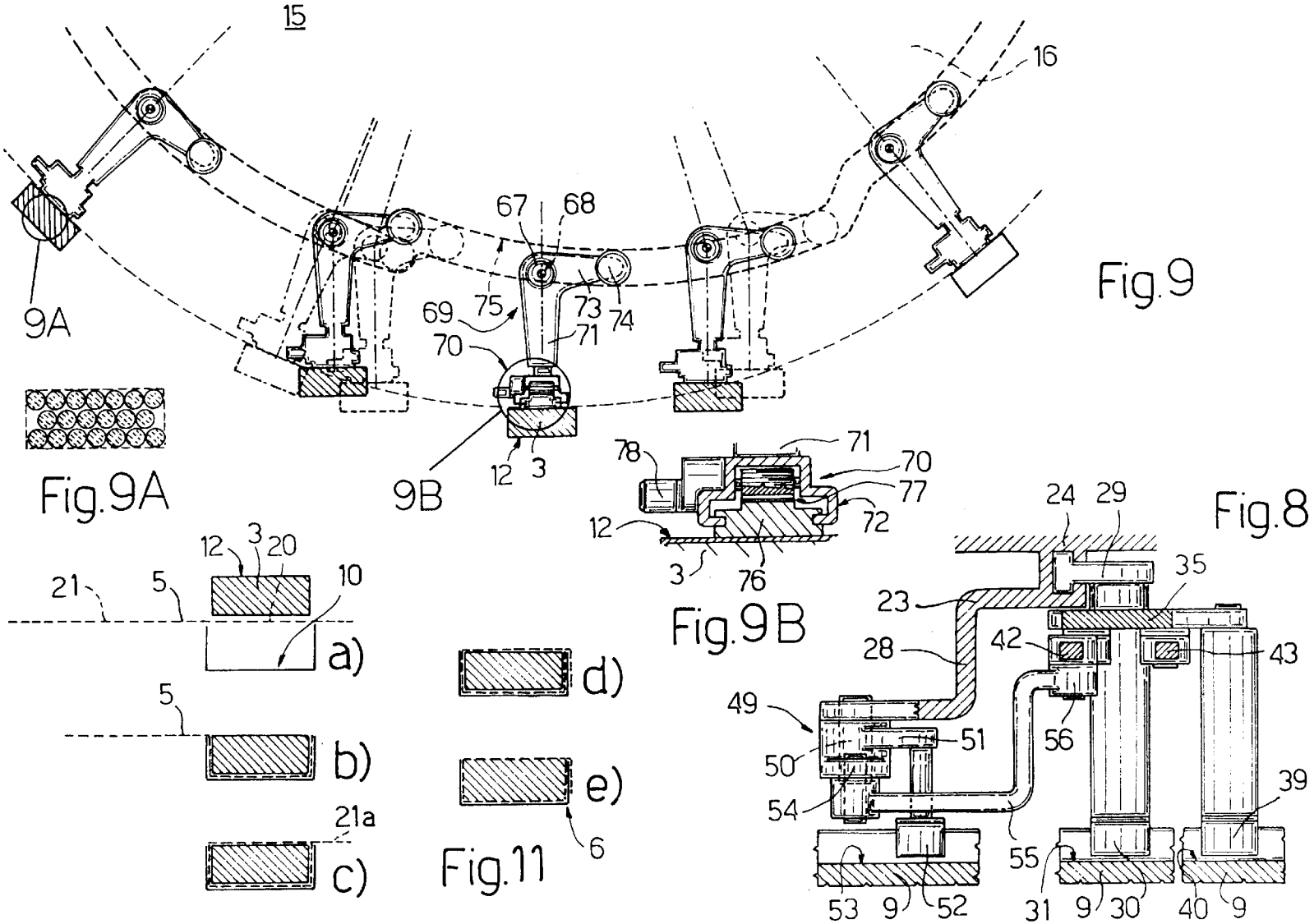

With reference to FIGS. 1 and 9, wheel 15 comprises, for each container 12, a pin 67 fixed to wheel 15 and presenting an axis 68 parallel to axis 8; a substantially L-shaped rocker arm 69 pivoting on pin 67 and for controlling the angular position of container 12 in relation to wheel 15; and an actuating assembly 70 movable in, and for controlling the movement of container 12 in, a direction parallel to axis 8.

Rocker arm 69 comprises an arm 71 fitted on its free end with a guide 72 extending in a direction parallel to axis 8; and a further arm 73 substantially perpendicular to arm 71, and fitted on its free end with a tappet roller 74 rotating about an axis parallel to axis 8 and engaged in rolling manner inside an annular groove 75 formed on the surface of cam 16 facing wheel 15 to regulate the angular position of rocker arm 69 about axis 68 of respective pin 67.

Assembly 70 comprises a slide 76 fitted in projecting manner, on its free end, with respective container 12, and which is moved along guide 72 by a rack-and-pinion transmission 77 driven by an electric motor 78.

Operation of wrapping unit 1 will be described with reference to the formation of one tubular wrapping 6, and as of the instant in which sheet 5 of wrapping material is fed by wheel 19, seat 10 and retaining element 13 are fed by wheel 7 along portion Al of path A, and container 12 is fed by wheel 15 along path B.

At transfer station 18, sheet 5 is transferred continuously from wheel 19 to wheel 7 so that, as stated, part (portion 20) is positioned on seat 10, and part (portion 21) on retaining element 13.

At this point, seat 10, together with retaining element 13, and respective container 12 are co-oriented so that they are positioned facing each other in a plane parallel to the plane joining the axes of wheels 7 and 15. More specifically, the movement of tappet roller 39 inside groove 40 rotates rocker arm 35 clockwise (in FIG. 2) about axis 34 of pin 33 and in relation to wheel 7, so that seat 10, connected integral with arm 36 of rocker arm 35, and retaining element 13, connected to rocker arm 35 by parallelogram 41, are also rotated in the same way. At the same time, the movement of tappet roller 74 inside groove 75 rotates rocker arm 69 anticlockwise (in FIG. 9) about axis 68 of pin 67 and in relation to wheel 15, so that container 12 is oriented in said position facing respective seat 10.

Subsequently, at the start of portion A2, the movement of tappet roller 30 inside groove 31 moves slide 29 along guide 24; and the movement of slide 29 causes rocker arm 35 and seat 10 to translate substantially radially in relation to wheel 7, so as to continuously insert container 12 inside seat 10 through opening 11, and so fold at least portion 20 of sheet 5 substantially in a U about container 12 and inside seat 10. From this point on and along the whole of portion A2, container 12 is maintained inside seat 10, and retaining element 13 is moved, in relation to seat 10, from the idle to the operating position to fold part of portion 21 of sheet 5 about and onto container 12, and leave a portion 21*a* projecting outwards in relation to container 12. More specifically, the movement of tappet roller 52 inside groove 53 rotates arm 51 of rocker arm 49 clockwise (in FIG. 2) about the axis of roller 52, and rotates arm 54 of rocker arm 49 clockwise (in FIG. 2) about pivot 50, so that connecting rod 55 is moved forwards in relation to the rotation direction of wheel 7, thus moving articulated parallelogram 41, which in turn moves retaining element 13.

Simultaneously with the movement of retaining element 13 from the idle to the operating position, slide 62 of folding assembly 57, guided by the movement of tappet roller 63 inside groove 65, slides along guide 61 from an idle position wherein it is aligned externally with seat 10, to an activated position wherein it projects radially outwards in relation to seat 10. Subsequently, when retaining element 13 is in the operating position, slide 62 returns to the idle position, and the teeth of comb element 66 are inserted inside comb-shaped end 14 of retaining element 13 to fold portion 21*a* of sheet 5 squarely and so complete the folding of sheet 5 about respective container 12.

At the end of portion A2, motor 78 is activated to move slide 76 along guide 72 via rack-and-pinion transmission 77, and so extract container 12 from seat 10 in a direction parallel to axis 8, so that group 3 of cigarettes 4 enclosed inside tubular wrapping 6 formed sheet 5 is left inside seat 10.

At this point, container 12 proceeds along path B without group 3 of cigarettes 4, and wrapping 6 is fed by wheel 7 along portions A4 and Al of path A.

We claim:

1. A method of continuously wrapping products (12) in respective sheets (5) of wrapping material, comprising:

continuously feeding along a given path (A) at least one empty seat (10) for accommodating a respective said product (12), together with a retaining element (13) for retaining a said sheet (5) of wrapping material; the seat (10) having a lateral opening (11), and the retaining element (13) being movable, in relation to the seat (10), between a first position to a first side of the seat (10), and a second position over the seat with a portion of said retaining element extending to a second side at said seat (10) and substantially closing said opening (11);

continuously feeding the sheet (5) of wrapping material in such a manner that a first portion (20) of the sheet (5) is positioned over the empty seat (10) and closing said opening (11), and a second portion (21) of the sheet (5) is engaged by the retaining element (13) in said first portion to draw the sheet (5) along said path (A);

continuously inserting said product (12) inside said empty seat (10), through said opening (11) closed by the first portion (20) of said sheet (5), so as to fill the empty seat (10) and fold at least the first portion (20) of the sheet (5) substantially in a U about the product (12) and inside the seat (10); and moving the retaining element (13) from the first to the second position, so as to fold at least part of the second portion (21) of the sheet (5) about and onto the product (13); the sheet (5) being mated with the retaining element (13) in such a position that, upon the said portion of said retaining element (13) being moved into the second position, an end portion (21*a*) of the second portion (21) of the sheet (5) is moved to said second side of said project seat (10); said end portion (21*a*) being folded squarely about the product (12) to complete a tubular wrapping (6) about the product (12).

2. A method as claimed in claim 1, wherein the product (12) is inserted continuously inside the empty seat (10) by feeding the empty seat (10) along a first path (A) coinciding with said given path (A), and the product (12) along a second path (B) having a portion (A2) common to the first path (A); the product (12) being advanced along the second path in time with the empty seat (10); the product (12) and the empty seat (10) being co-oriented upstream from said common portion (A2); and insertion of the product (12) inside the seat (10) being completed at the start of the common portion (A2).

3. A method as claimed in claim 2, wherein the retaining element (13) is moved from the first to the second position as the seat (10) travels along said common portion (A2), and before folding said end portion (21*a*) of said second portion (21) of the sheet (5).

4. A method as claimed in claim 2, wherein said seat (10) and said retaining element (13) are fed along said first path (A) by a first wheel (7), and the product (12) is fed along said second path (B) by a second wheel (15); said first and second wheels (7, 15) rotating about respective axes parallel to each other.

5. A method as claimed in claim 4, wherein said common portion (A2) is obtained by moving at least one of said seat (10) and said product (12) radially in relation to said first and second wheels (7, 15) so that said first (A) and second (B) paths coincide along the common portion (A2).

6. A method as claimed in claim 4, wherein said sheet (5) of wrapping material is fed, in time with said seat (10) and said retaining element (13), by a third conveyor wheel (19) rotating continuously and substantially tangent to said first wheel (7); said sheet (5) of wrapping material being transferred from said third wheel (19) to said first wheel (7) at a transfer station (18) located at a point of tangency of said first and third wheels (7, 19) and upstream from said common portion (A2).

7. A method of continuously wrapping a group (3) of elongated elements (4) in respective sheets (5) of wrapping material comprising:

continuously feeding along a first path (A) at least one empty seat (10) together with a retaining element (13) for retaining a said sheet (5) of wrapping material; the seat (10) having a lateral opening (11), and the retaining element (13) being movable, in relation to the seat (10), between a first position to the side of the seat (10), and a second position over the seat with a portion of said retaining element extending to a second side at said seat (10) and substantially closing said opening (11);

continuously feeding the sheet (5) of wrapping material in such a manner that a first portion (20) of the sheet (5) is positioned over the empty seat (10) and closes said opening (11), and a second portion (21) of the sheet (5) is engaged by the retaining element (13) in said first position to draw the sheet (5) along said first path (A);

advancing a tubular container (12) accommodating said group (3) of elongated elements (4) along a second path (B) having a portion (A2) common to the first path (A); the container (12) being advanced along the second path (B) in time with the empty seat (10), the container (12) and the empty seat (10) being co-oriented upstream from said common portion (A2);

continuously inserting said container (12) inside said empty seat (10), through said opening (11), so as to arrange the group (3) inside the seat (10) and to fold at least the first portion (20) of the sheet (5) substantially in a U about the container (12) and inside the seat (10); the insertion of the container (12) inside the seat (10) being completed at the start of the common portion (A2);

moving the retaining element (13) from the first to the second position, so as to fold at least part of the second portion (21) of the sheet (5) about and onto the container (12); the sheet (5) being mated with the retaining element (13) in such a position that, upon the said portion of said retaining element (13) being moved into the second position, an end portion (21*a*) of the second portion (21) of the sheet (5) is moved to project said second side of said seat (10);

folding said end portion (21*a*) squarely about the container (12) to complete a tubular wrapping 96) about the container; and withdrawing said container (12) from the seat (10) prior to said container (12) and said seat (10) leaving said common portion (A2), so as to leave said group (3) of elongated elements (4) inside said seat (10) and enclosed in said sheet (5); said container (12) being withdrawn from said seat (10) in a direction crosswise to said common portion (A2).

8. A method as claimed in claim 7, wherein the container (12) and the empty seat (10) are co-oriented upstream from said common portion (A2).

9. A method as claimed in claim 7, wherein the retaining element (13) is moved from the first to the second position as the seat (10) travels along said common portion (A2), and before folding said end portion (21*a*) of said second portion (21) of the sheet (5).

10. A method as claimed in claim 8, wherein said seat (10) and said retaining element (13) are fed along said first path (A) by a first wheel (7), and the container (12) is fed along said second path (B) by a second wheel (15); said first and second wheels (7, 15) rotating about respective axes parallel to each other.

11. A method as claimed in claim 10, wherein said common portion (A2) is obtained by moving at least one of said seat (10) and said container (12) radially in relation to said first and second wheels (7, 15) so that said first (A) and second (B) paths coincide along the common portion (A2).

12. A method as claimed in claim 10, wherein said sheet (5) of wrapping material is fed, in time with said seat (10) and said retaining element (13), by a third conveyor wheel (19) rotating continuously and substantially tangent to said first wheel (7); said sheet (5) of wrapping material being transferred from said third wheel (19) to said first wheel (7) at a transfer station (18) located at a point of tangency of said first and third wheels (7, 19) and upstream from said common portion (A2).

13. A method as claimed in claim 7, wherein said elongated elements comprises cigarettes (4).

* * * * *